United States Patent [19]

Lillicrap

[11] Patent Number: 4,611,338

[45] Date of Patent: Sep. 9, 1986

[54] CHANNEL INDUCTION FURNACES

[75] Inventor: Douglas C. Lillicrap, Waverton, United Kingdom

[73] Assignee: The Electricity Council, England

[21] Appl. No.: 649,335

[22] Filed: Sep. 11, 1984

[30] Foreign Application Priority Data

Feb. 21, 1984 [GB] United Kingdom ..... 8404568

[51] Int. Cl.[4] ..... H05B 5/14

[52] U.S. Cl. ..... 373/161

[58] Field of Search ..... 373/159–165

[56] References Cited

U.S. PATENT DOCUMENTS 4,458,353 7/1984 Göte ..... 373/161

*Primary Examiner*—Roy N. Envall, Jr.

*Attorney, Agent, or Firm*—Beveridge, DeGrandi & Weilacher

[57] ABSTRACT

The invention relates to channel induction furnaces employed for melting metals.

A channel is arranged to extend downwardly from a bath and to form a loop whereby molten metal in the bath can pass into the looped channel to form a closed electrically conducting loop. A laminated iron core passes through a coil and forms a closed magnetic circuit linked with the coil and channel. Consequently, alternating current applied to the coil induces currents to flow in the molten metal in the channel, which metal is therefore heated. The molten metal is contained in the channel within a refractory lined vessel. With application of the alternating current to the coil electromagnetic forces are produced which are directed away from the walls of a channel. Thus a squeezing action is applied to the metal which produces an increase in static pressure towards the center of the channel relative to that at the wall. This pressure fluctuates from zero to a maximum value at twice the frequency of the induced current. For some value of these forces, the minimum wall pressure will be less than the vapor pressure of the most volatile species in the molten metal. Thus a vapor filled cavity can grow on the wall facing the core and upon collapse can damage the refractory lining of the channel. Therefore, to overcome this problem the channel wall nearest the induction core is shaped to follow a contour of constant current density or to follow a contour of constant static pressure.

11 Claims, 3 Drawing Figures

CHANNEL INDUCTION FURNACES

BACKGROUND OF THE INVENTION

This invention relates to channel induction furnaces such as are used for melting metals.

The invention applies to furnaces for melting all types of metals but is particularly applicable to metals having high electrical conductivity such as aluminium and copper. For such metals high current densities are required to produce a high power input. If the channel cross sectional dimensions are comparable with the depth of penetration of the induced current then the interaction of this current with the net magnetic induction produces electromagnetic forces directed away from the walls of the channel. This squeezing action on the metal, which is referred to as an electromagnetic pinch, produces an increase in static pressure towards the centre of the channel relative to that at the wall. If the current density is not too high, this increase in static pressure is balanced by the static head of the molten metal above the channel. However, there will be some limiting current density, and corresponding maximum power input, for which the increase in static pressure exceeds the head of liquid metal and the metal is forced away from the walls of the channel. As the current is now concentrated into a conductor of smaller cross sectional area, the pinch forces increase causing a still greater contraction of the conducting area. For sufficiently large power inputs, a break occurs in the metal thus interrupting the current. Without a current there are no electromagnetic forces and the metal flows back under the influence of gravity to re-establish the current path. The cycle then restarts leading to a repetitive interruption of the electrical power. The power input for which pinching occurs will be lowest for metals of high electrical conductivity and low density, such as aluminium.

The pinch effect and the limitations it imposes on power input are well known to those familiar with channel induction furnaces. It is also known that the pinching effect can be avoided by making the radial width, W, of the channel considerably greater than the depth $\delta$ of penetration of the induced current. The radial width, W, is measured radially outward from the axis of the induction coil in the plane at right angles to the coil axis and in a direction normal to the axis of the channel at the point of measurement. Although this arrangement avoids the pinch effect, cavitation phenomena (described in more detail below) will occur for sufficiently high current densities.

SUMMARY OF THE PRESENT INVENTION

It is an object of the invention to provide improvements in the design of channels having large radial widths so as to maximise the power input per unit length that can be obtained without cavitation occurring.

According to the present invention there is provided a channel induction furnace having a bath for containing molten metal with a channel-forming loop extending downwardly from the bath, a ferromagnetic core forming a closed magnetic circuit linked with the channel and an alternating current energised coil on the core, wherein the channel wall nearest the induction coil is shaped to follow a contour of constant current density or to follow a contour of constant static pressure.

BRIEF DESCRIPTION OF THE DRAWINGS

In the following description, reference will be made to the accompanying drawings in which.

DETAILED DESCRIPTION

Figure 1:
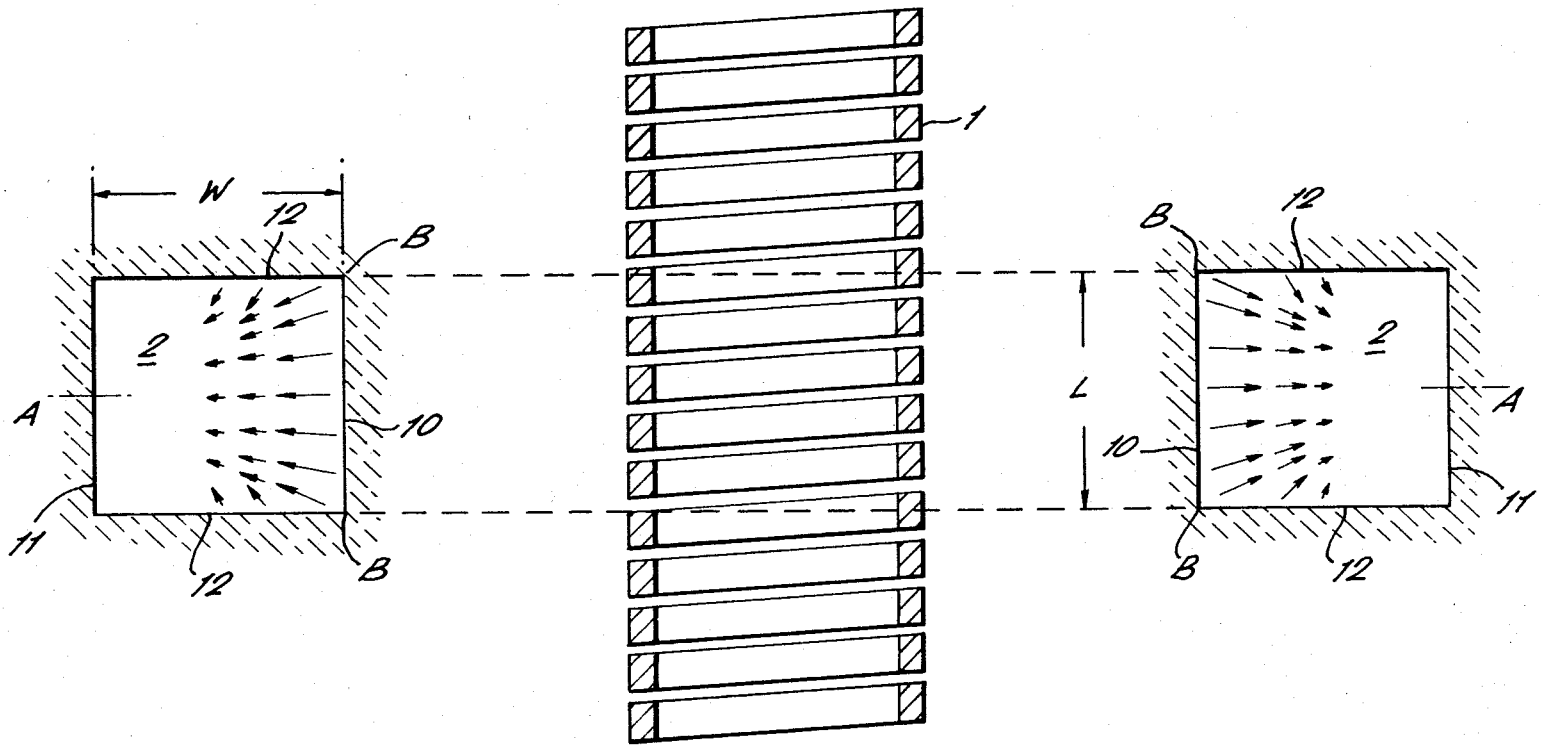
FIG. 1 is a diagrammatic section through a channel and coil of a channel induction furnace showing the strength and direction of electromagnetic forces on the metal for explanatory purposes.

To understand the improvement made in the present invention the distribution of the electromagnetic forces acting on the metal must be considered in more detail. FIG. 1 shows a diagrammatic sectional view through the axis of a coil 1, around which there is a channel 2. For clarity, other parts of the furnace, such as the iron core passing through the coil, are not shown. Electromagnetic forces acting on the metal are represented by arrows the length and direction of which represent the magnitude and direction respectively of the time average forces. The distribution shown is that for a radial channel width, W, of several penetration depths. The forces are greatest at the inner wall nearest the coil and decay to low values over a radial distance of 2 or 3 penetration depths from this wall. A force distribution such as this produces a recirculating flow in the plane of FIG. 1 and reduces the static pressure at the inner wall 10 (that is the wall nearest the coil) below that at the outer wall 11 of the channel 2. The electromagnetic forces responsible for this pressure distribution are always directed radially outwards from the coil but fluctuate from zero to a maximum value at twice the frequency of the induced current. The pressure at the inner wall 10 therefore fluctuates from that corresponding to the static head of liquid metal above the channel to a lower value depending on the magnitude of the electromagnetic forces. For some value of these forces, the minimum wall pressure will be less than the vapour pressure of the most volatile species in the molten metal. A vapour filled cavity grows on the inner wall as the electromagnetic forces increase. The cavity will immediately collapse when the electromagnetic forces decrease half a cycle later. This phenomena has all the characteristics of cavitation except the metal need not be flowing for it to occur. What motion does occur causes further variations in static pressure but for the conditions in a channel furnace these variations are smaller than the direct effect of the electromagnetic forces tending to push the metal away from the inner wall. Unless the current density is extremely high, the cavities remain small compared to the cross sectional area of the channel. Consequently, the channel current is only slightly perturbed and the current path is not broken, as in those designs where the pinch effect is present. The most serious effect of cavitation is the very high impulsive forces that are created when a cavity collapses. These produce very high stresses in the refractory wall of the channel in the immediate vicinity of the collapsing cavity. Experience has shown that this can cause rapid erosion of the refractory over a small local area leading to penetration of the metal through the refractory. Thus cavitation at the inner wall imposes a maximum limit on the power input per unit length in channels having radial widths of several penetration depths.

The present invention shows how to obtain the maximum power per unit length without cavitation occurring. As is well known the electromagnetic force is equal to the vector product of the current density and the magnetic induction. The obvious way to reduce these forces is to reduce the current density by increasing the cross sectional area of the current carrying part of the channel. Electromagnetic theory shows that practically all the current flows through the region within two penetration depths of the inner wall. Consequently, increasing the already large radial width W will have only a minor effect on the current density distribution. In these circumstances the current density is controlled primarily by the axial width, L, of the channel, that is the width measured parallel to the coil axis (see FIG. 1). If this axial width is less than about two penetration depths, then for a given total channel current, the current density varies almost inversely as the channel axial width. For axial widths, greater than about two penetration depths, there are large variations in current density with axial position in the channel. If the mid planes of the induction coil 1 and channel 2 coincide, then at a fixed distance from the inner wall 10, the current density is a minimum on the mid plane (A—A in FIG. 1) and increases to a maximum at each side wall 12 of the channel. Maximum current densities therefore occur in the two corners B nearest to the induction coil 1. We have found that, for a given total channel current, this maximum current density decreases only very slowly with increasing axial width. Consequently, higher power inputs per unit length cannot be achieved simply by increasing the axial width. The high current densities in the corners will still lead to cavitation in these regions even when the average current density in the channel is less than that for which cavitation would be expected. In the present invention this problem is overcome by the novel way in which the current density distribution is controlled. In the first instance, for a given total channel current, an axial width is selected such that the current density on the mid plane A—A of the channel 2 is low enough to avoid cavitation at the inner wall 10. The inner wall 10 is then shaped so that the current density or the static pressure remains constant along the wall. That is to say, the wall is shaped to follow a contour of constant current density or constant static pressure. This effectively eliminates the corner regions where the current density would have been too high. Shaping the inner wall causes some adjustment of the current density on the mid plane but successive approximations rapidly converge to a satisfactory choice of axial width L and cross section shape. The current density distribution then obtained produces the maximum power per unit length for the specified total channel current, while avoiding cavitation at the inner wall.

Thus, according to one aspect of the invention, in a channel induction furnace having a bath for containing molten metal with a channel forming loop extending downwardly from the bath, a ferromagnetic core forming a closed magnetic circuit linked with the channel and an alternating current energised coil on the core, the channel wall nearest the induction coil is shaped to follow a contour of constant current density or to follow a contour of constant static pressure.

The current density distribution in the channel may be controlled by the combination of selecting the axial width of the channel and shaping the wall of the channel nearest the induction coil, such that at the maximum power rating for the channel, the minimum static pressure at the shaped wall is greater than the vapour pressure of the most volatile species in the molten metal.

Thus the present invention enables the channel section to be optimised for maximum power input per unit length of channel and with a selected static pressure which can be chosen to prevent the cavitation problems discussed above. Thus in a furnace for melting a predetermined metal containing volatile constituents and for operation at a predetermined maximum operating power, said shaped wall may be so shaped that the static pressure on said shaped wall is greater than the vapour pressure of the most volatile constituent. The static pressure on said wall is the result of all the forces acting on the metal, the most important of which are electromagnetic and gravitational forces and, to a lesser extent, inertial forces arising from the motion of the metal.

In a furnace arranged for melting aluminium and for operation at a predetermined maximum operating power, said shaped wall may be so shaped that the static pressure on said shaped wall is greater than the vapour pressure of hydrogen in solution in the aluminium.

In a furnace arranged for melting aluminium or copper and for operation at a predetermined maximum operating power, said shaped wall may be so shaped that the static pressure on said shaped wall is greater than the vapour pressure of any volatile alloying metal species.

Optimisation of the axial width and cross sectional shape of the channel may be carried out using a mathematical mode of the furnace. Computations may be made on a computer to obtain the current density distribution, electromagnetic forces and power density distribution. Using the calculated electromagnetic forces, an estimate may then be made of the static pressure at the inner wall on the mid plane of the channel. The minimum value of this pressure may be chosen to be always at least 0.1 bar and preferably 0.2 bar greater than the vapour pressure of the most volatile species present in the molten metal. If the minimum static pressure at the wall is too low or significantly higher than this critical value, the axial width of the channel is adjusted and the calculation repeated. Strictly the inner wall of the channel should be shaped to make the static pressure constant along the wall in the axial direction of the channel. To arrive at the required shape would require extensive computation of the turbulent flow in the channel. Fortunately, this can be avoided by noting that, in practice, static pressure variations due to metal motion are of the order of 0.1 bar while pressure changes as a direct result of the electromagnetic body force are of the order of 1.0 bar. For engineering design purposes, in which there is a safety margin of 0.1 to 0.2 bar in the minimum value of the static pressure, it is sufficient to make the inner wall follow a contour of constant current density. However, the inner wall of the channel may be shaped to follow a contour of constant current density or a contour of constant static pressure.

As indicated above, the axial width and the shape of the wall nearest the coil are preferably selected such that the minimum static pressure along the shaped wall is at least 0.1 bar greater than the vapour pressure of the most volatile species present in the molten metal. The axial width of the channel is preferably in the range of 4 to 6 penetration depths for the current in the molten metal at the energising frequency.

The radial width of the channel is preferably in the range of 3 to 5 penetration depths for the current in the molten metal at the energising frequency.

One embodiment of the invention will now be described with reference to FIGS. 2 and 3.

Figure 2:
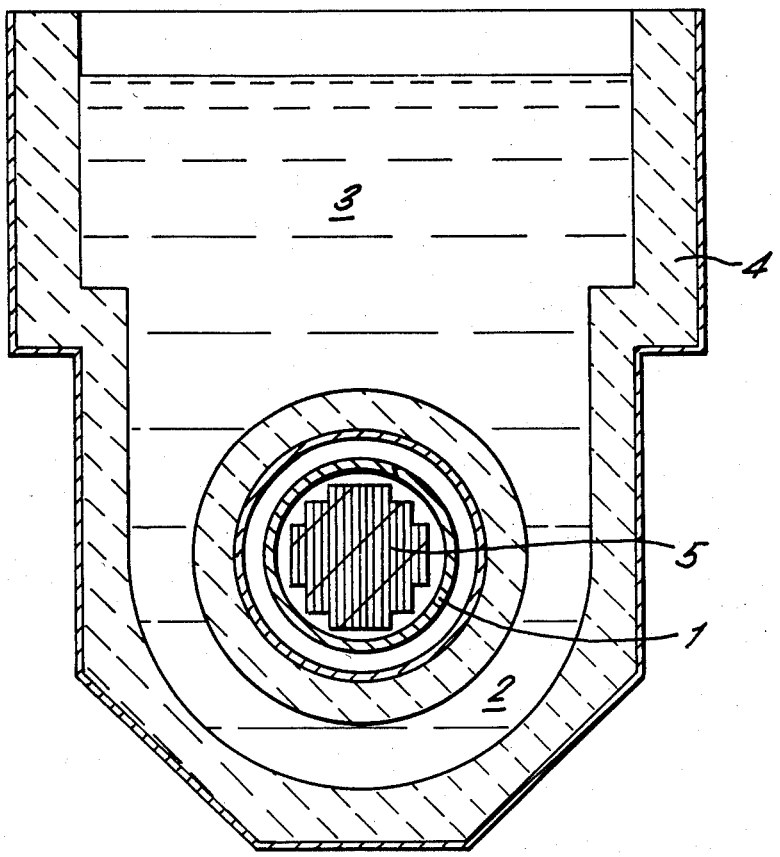
FIG. 2 is a vertical section through a channel induction furnace.

Referring to FIG. 2, the channel induction furnace has an induction coil 1 around which is maintained a loop of molten metal. The channel 2 constituting this loop of molten metal is connected to a bath 3 of molten metal, located above the loop. The molten metal is contained in a refractory lined vessel 4. A laminated iron core 5 passes through the coil 1 and forms a closed magnetic circuit linked with the coil 1 and channel 2. When an alternating current passes through the coil 1, currents are induced in the molten metal in the channel 2, which metal is therefore heated. This heat is conveyed to the metal in the bath 3 above by conduction and by mixing of metal between the loop and bath. Solid metal is melted by adding it to the molten bath which is maintained significantly above the melting temperature. Periodically molten metal is removed from the bath typically by tilting the furnace so that the metal can be poured out.

This particular furnace is for melting aluminium and the primary cause of cavitation is the presence of dissolved hydrogen in the molten aluminium. Thus it is the vapour pressure of this hydrogen which is considered in designing the shape of the channel to maximise power input whilst preventing cavitation.

Figure 3:
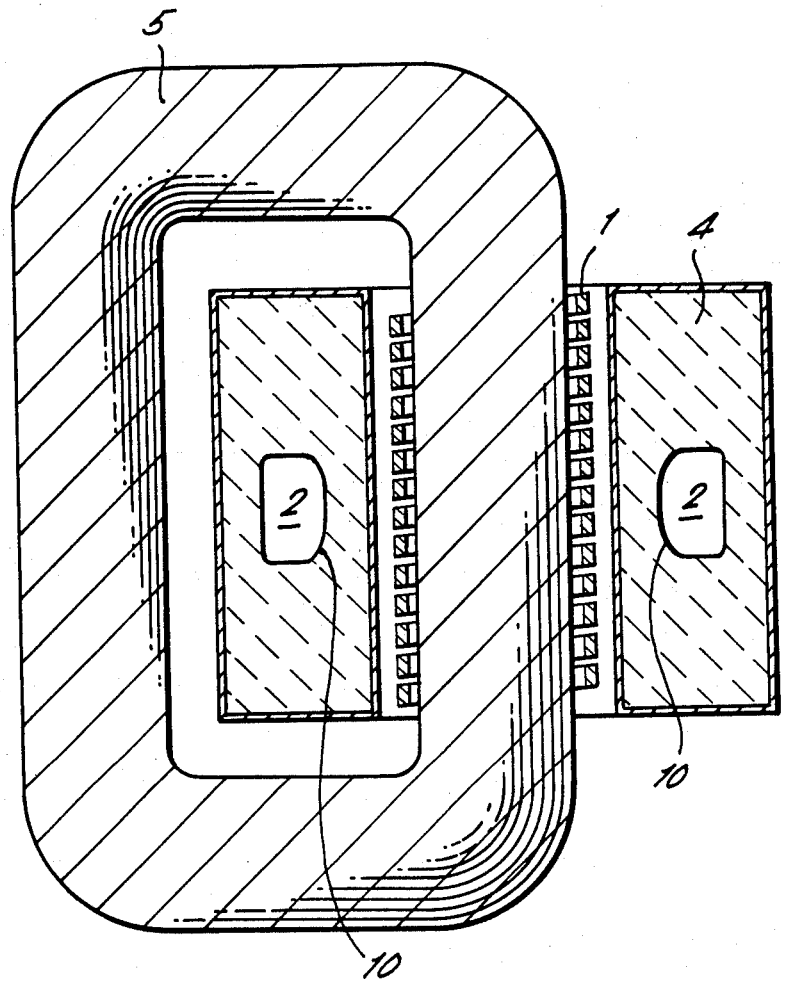
FIG. 3 is a cross section through the channel, core and coil of a furnace forming one embodiment of the invention.

The particular advantage of the present design is illustrated in FIG. 3, which shows the cross sectional shape of a channel designed for a maximum power input of 150 kW per meter length in pure aluminium for an energising frequency of 50 Hz. The penetration depth, $\delta$, at this frequency is 32 mm and the axial width in this particular embodiment is $5.7\delta$ while the radial width is $3.8\delta$. The inner wall 10 is shaped to follow a contour of constant current density. These dimensions lie within a preferred range of $4\delta$ to $6\delta$ for the axial width and $3\delta$ to $5\delta$ for the radial width. The power factor of the furnace decreases with increasing axial width and the preferred range $4\delta$ to $6\delta$ represents a balance between the need to maximise power per unit length and to minimise the cost of compensating capacitors. For a particular channel cross section, and hence maximum power input per unit length, the circumferential length of the channel must be sufficient to generate the required power input for the furnace. The technique described above enables this power input to be achieved in the smallest diameter loop for which cavitation can be avoided, and hence represents a compact and cost effective design.

For high power furnaces, multi-loop designs can be more cost effective than a single large diameter loop and the invention also encompasses such designs in which each loop has an optimum cross sectional shape and size.

What we claim is:

1. A channel induction furnace comprising means defining a bath for containing molten metal, means defining a channel-forming loop extending downwardly from the bath, a ferromagnetic core forming a closed magnetic circuit linked with the channel, and an alternating current energised induction coil on the core, the channel wall nearest the induction coil being shaped to follow a contour of constant current density or to follow a contour of constant static pressure.

2. A channel induction furnace as claimed in claim 1 wherein the axial width of the channel and shaping the wall of the channel nearest the induction coil are selected in combination to control the current density distribution in the channel such that at the maximum power rating for the channel the minimum static pressure at the shaped wall is greater than the vapour pressure of the most volatile species in the molten metal.

3. A channel induction furnace as claimed in claim 1 adapted particularly for melting a predetermined metal containing volatile constituents, wherein said shaped wall is so shaped that at a predetermined maximum operating power the static pressure on said shaped wall is greater than the vapour pressure of the most volatile constituent.

4. A channel induction furnace as claimed in claim 1 adapted particularly for melting aluminum, wherein said shaped wall is so shaped that at a predetermined maximum operating power the static pressure on said shaped wall is greater than the vapour pressure of hydrogen in solution in the aluminum.

5. A channel induction furnace as claimed in claim 1 adapted particularly for melting aluminum or copper, wherein said shaped wall is so shaped that at a predetermined maximum operating power the static pressure on said shaped wall is greater than the vapour pressure of any volatile alloying metal species.

6. A channel induction furnace as claimed in claim 3, wherein the axial width and the shape of the wall of the channel nearest the coil are selected such that the minimum static pressure along the shaped wall is at least 0.1 bar greater than the vapour pressure of the most volatile species present in the molten metal.

7. A channel induction furnace as claimed in claim 4, wherein the axial width and the shape of the wall of the channel nearest the coil are selected such that the minimum static pressure along the shaped wall is at least 0.1 bar greater than the vapour pressure of the most volatile species present in the molten metal.

8. A channel induction furnace as claimed in claim 5, wherein the axial width and the shape of the wall of the channel nearest the coil are selected such that the minimum static pressure along the shaped wall is at least 0.1 bar greater than the vapour pressure of the most volatile species present in the molten metal.

9. A channel induction furnace as claimed in claim 1, wherein the channel cross sectional shape and size are such as to minimise the channel diameter required to obtain a particular maximum power.

10. A channel induction furnace as claimed in claim 1 adapted particularly for melting a preselected metal and in which the axial width of the channel is in the range of 4 to 6 penetration depths for the current in the molten metal at the energising frequency.

11. A channel induction furnace as claimed in claim 1 adapted particularly for melting a preselected metal and in which the radial width of the channel is in the range of 3 or 5 penetration depths for the current in the molten metal at the energising frequency.

* * * * *